United States Patent [19]

Henry

[11] 4,231,806

[45] Nov. 4, 1980

[54] FLUID BARRIER MEANS FOR PARTS WASHER APPARATUS

[75] Inventor: William P. Henry, Chillicothe, Ill.

[73] Assignee: Caterpillar Tractor Co., Peoria, Ill.

[21] Appl. No.: 936,960

[22] Filed: Aug. 25, 1978

[51] Int. Cl.[3] ..... B08B 7/04

[52] U.S. Cl. ..... 134/18; 134/34; 134/72; 134/56 R; 134/154; 134/25.2; 118/314; 118/DIG. 2

[58] Field of Search ..... 134/25 A, 32, 18, 34, 134/29, 26, 10, 42, 131, 71, 72, 56 R, 56 D, 57 R, 201, 57 D, 104, 109, 110, 200, 198, 191, 151, 122 R, 64 R, 199, 154; 239/193; 427/420; 118/DIG. 4, 314

[56] References Cited

U.S. PATENT DOCUMENTS

| | | | |
|---|---|---|---|
| 870,766 | 11/1907 | Eaton | 134/199 |
| 2,665,171 | 1/1954 | Stievater | 134/199 |
| 3,434,882 | 3/1969 | Carolin | 134/199 |
| 3,693,953 | 9/1972 | Michel | 134/34 |
| 3,746,019 | 7/1973 | Hansen | 134/56 D |
| 3,868,272 | 2/1975 | Tardoskegyi | 134/72 |
| 4,066,472 | 1/1978 | Perry | 134/25 A |

FOREIGN PATENT DOCUMENTS

| | | | |
|---|---|---|---|
| 1066070 | 9/1959 | Fed. Rep. of Germany . | |
| 1546111 | 7/1970 | Fed. Rep. of Germany | 134/34 |
| 2211310 | 9/1973 | Fed. Rep. of Germany | 134/56 D |

*Primary Examiner*—S. Leon Bashore
*Assistant Examiner*—Michael Goldman
*Attorney, Agent, or Firm*—Phillips, Moore, Weissenberger, Lempio & Majestic

[57] ABSTRACT

A barrier means for a parts washer apparatus including a fluid curtain (30, 32) generated at the entrance and exit of the wash zone (12) of the parts washer (10), said fluid curtain defined in a thin planar shape and substantially covering the opening to and exit from said wash zone. The fluid barrier (30, 32) is produced by the flowing of fluid over one or more edges (36, 46) of a reservoir (34) positioned at the top of said wash zone (12), said edge (36, 46) defined such that said fluid flows thereover in a uniform manner. Alternately, said fluid curtain is generated by fluid emanating from a plurality of nozzles (84), each nozzle defined with a fan-shaped opening such that a laminar flow of fluid (83) is generated thereby.

3 Claims, 3 Drawing Figures

FLUID BARRIER MEANS FOR PARTS WASHER APPARATUS

BACKGROUND OF THE INVENTION

In prior art parts washer systems, rubber flaps are used at the entrance and exit to the wash zone of the washer to isolate the wash zone from the surrounding environment and from subsequent parts washer zones. Usually, when a part is to be washed, it first goes through the wash zone, then perhaps a rinse zone, and finally a dryer. In the prior art, each of these zones were isolated from one another by such rubber flaps, or by other even less desirous means. These rubber flaps, comprising either a solid sheet or a series of slit sheets, attempt to confine fluid spray to the inside of a specific zone and to further retain the heat therein. The difficulty with such rubber sheets is that the different configuration of the parts being washed and their physical sizes, were constantly causing the rubber material to tear, thereby permitting fluid from the wash and rinse zones to combine, and allowing heat and water vapor to otherwise be dissipated. This has created problems in the cleaning and recharging of the supply tanks for each of the zones, and further resulted in high maintenance costs due to the need for rubber flap replacement.

Further, present rubber flap doors, even when not torn, only partially block heated air and vapor movement, especially when a part is in the process of moving past such a flap. At such times air and vapor are able to escape past the flaps. This is caused in part by the fact that the rubber flaps open considerably as parts on the continuous moving conveyor of a parts washer cause them to deflect. The wash spray typically found in a wash zone is quite hot. The efficiency of this wash zone in terms of energy wasted is substantially affected if much of this heat in the form of vapor is lost from the wash zone, instead of recycled therein. A recent energy study on a washer showed that greater than half of the washer's input energy was dissipated in vaporization loss. Similarly, vapor that is allowed to escape into a dryer zone would make drying of the parts that much less efficient.

SUMMARY OF THE INVENTION

The present invention is directed to overcoming one or more of the problems as set forth above.

The present invention provides for replacement of the prior art rubber flaps with an improved means for generating a barrier for isolating the wash zone from an adjacent zone in the parts washer. This barrier means comprises a fluid curtain defined preferably in a planar shape and positioned across the opening of the wash zone along which parts are conveyed through the parts washer. In one embodiment, fluid is caused to flow over one or more edges of a reservoir positioned at the top of the wash zone, to generate thereby a laminar fluid flow or curtain. A second embodiment provides generation of a fluid curtain by means of a plurality of nozzles positioned about the opening, each nozzle defined with a pinched end or fan shaped opening such that a laminar flow of fluid is generated thereby.

The present invention further envisions fluid curtains, of the type above described, positioned at the entrance and exit to both the washer zone and to other zones in a parts washer apparatus.

DESCRIPTION OF A PREFERRED EMBODIMENT

Figure 1:
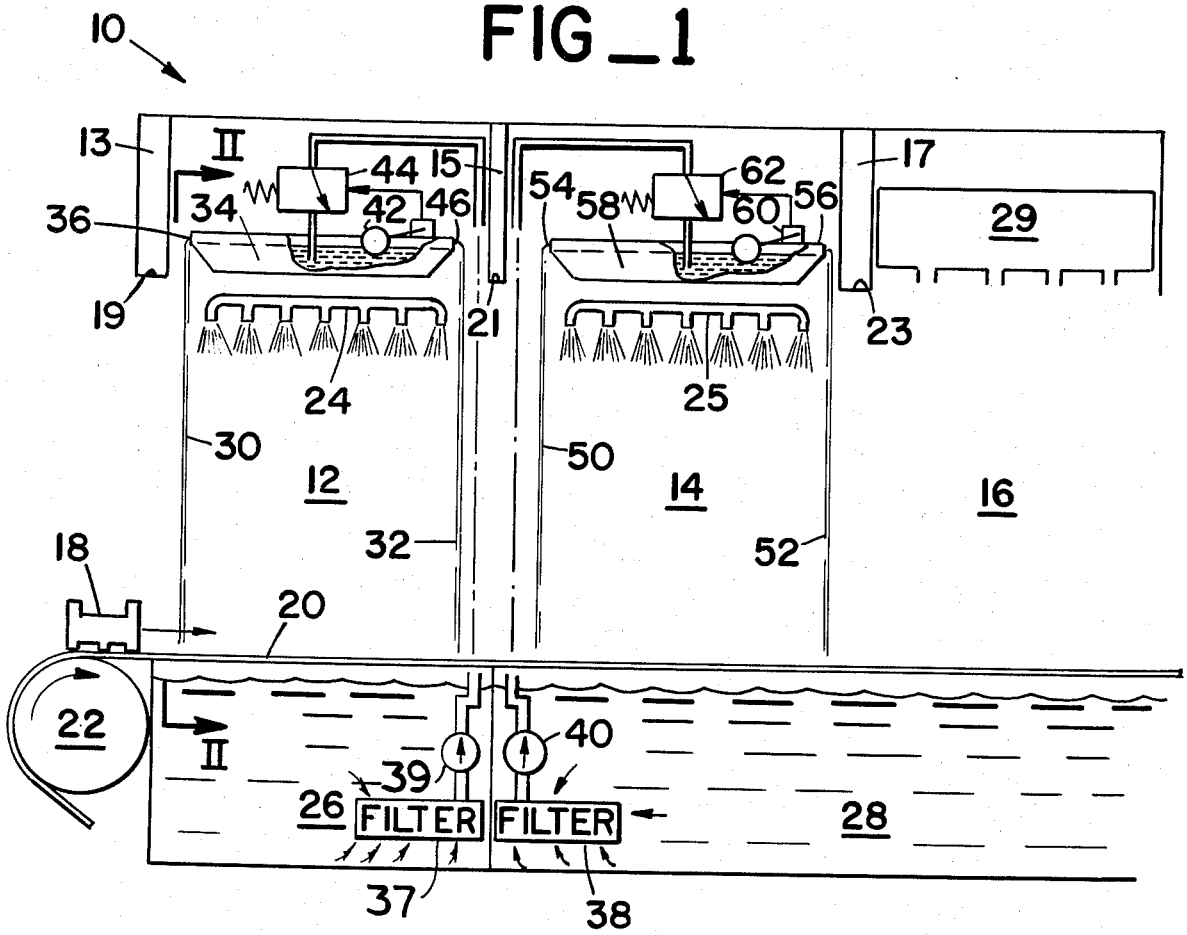
FIG. 1 illustrates in side view, a parts washer apparatus of the present invention.

The parts washer apparatus of the present invention is shown generally in side view at 10 in FIG. 1. A conventional parts washer includes three separate zones, a wash zone 12, a rinse zone 14, and a drying zone 16. Wall members 13, 15 and 17 respectively define an entrance passage 19 into the wash zone 12, a passage 21 between the wash zone and the rinse zone 14, and a passage 23 between the rinse zone and the drying zone 16. Parts, such as the one shown at 18, are conveyed through each of said passages and zones by means of a conventional continuously moving conveyor 20. The conveyor 20 is driven by conventional means such as by means of a powered roller 22.

As a part 18 is conveyed into the parts washer apparatus, it first enters through passage 19 into the wash zone 12. A conventional wash zone 12 has a plurality of nozzles 24 positioned at the top of the wash zone, said nozzles spraying a high temperature fluid spray down onto the part 18, the spray containing appropriate detergents, etc. or being of proper solvent properties, e.g., a grease solvent if grease is to be removed from the parts, etc. Fluid is normally supplied to the nozzles 24 in a conventional manner from a fluid catch basin 26. The fluid is recycled to minimize fluid waste and to reduce heat loss. A conventional rinse zone 14 also contains a plurality of nozzles 25 for rinsing said part 18. The fluid used therein is recycled in a conventional manner from a fluid catch basin 28. Finally, the drying zone 16 normally includes a hot air blower 29 for drying of the part 18 therein.

The present invention provides an improved barrier for isolating said wash zone 12 from the external environment and from an adjacent zone in the parts washer. Said means comprises barrier generation means including means for generating one or more fluid curtains, shown at 30 at the entrance to the wash zone 12, and at 32 at the exit from said wash zone. The barrier generation means is designed to generate a fluid curtain preferably in a thin planar shape which substantially covers each passage of the wash zone 12 through which each said part 18 is conveyed during a given washing operation. A curtain is generated as a result of the surface tension of the fluid which keeps the fluid from breaking up into separate drops, e.g., a sheet effect is obtained. Consequently, as the part 18 moves through the fluid curtain, a fluid envelope is created over the contours of the part 18. As a result, little or no vapor is allowed to escape from the wash zone 12.

FIG. 1 also illustrates one embodiment of a means for generating the fluid curtains 30 and 32. A reservoir means, comprising reservoir 34, is positioned at the top of the wash zone 12. The reservoir 34 is designed to contain fluid supplied from a fluid source. In the present embodiment, this fluid source may be the fluid catch basin 26 used to catch fluid used in the wash zone 12 of the parts washer apparatus. The fluid source further may comprise filter means 37 and pump means 39 for transmitting the fluid to the reservoir 34 at the top of the washer zone 12. The fluid source is designed to provide fluid with little or no debris therein, to ensure proper operation of the fluid curtain generation means.

The reservoir 34 has at least one edge 36 shaped such that fluid in said reservoir means will flow over said edge 36 in a uniform laminar manner. A conventional fluid level sensing means 42 and valve means 44 operating responsive thereto enables the fluid level in said reservoir means to remain at a constant fixed level, causing the fluid stored therein to continue to flow over said edge 36 at a constant rate. The level is further set such that the fluid flow retains the shape of a substantially thin planar sheet.

Note that a second edge 46 in reservoir 34 provides means for causing fluid in said reservoir 36, which flows over said second edge, to thereby generate the fluid curtain 32.

Figure 2:
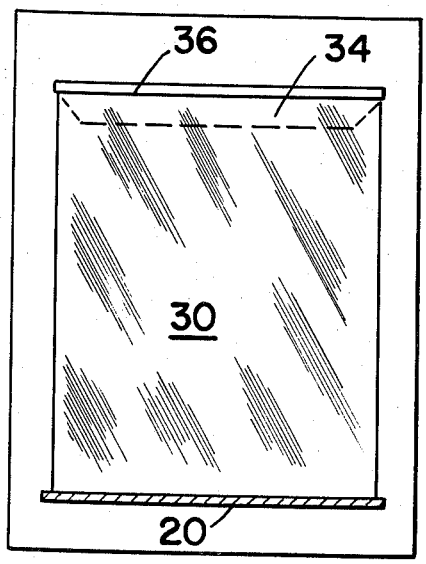
FIG. 2 is an end view of the fluid curtain of the present invention taken along lines II—II of FIG. 1.

FIG. 2 illustrates an end view of the above-described embodiment of the fluid curtain of the present invention. As can be seen in FIG. 2, the edge 36 of reservoir 34 allows fluid stored therein to flow over said edge and thereby create said fluid curtain 30 across the passage 19 of wash zone 12.

Referring again to FIG. 1, the present invention further envisions fluid curtains positioned at the entrance to and exit from said rinse zone 14. These fluid curtains are shown at 50 and 52. These fluid curtains are generated in the same manner as are fluid curtains 30 and 32, by means of respective edges 54 and 56 formed in a reservoir 58 having fluid stored therein. Again, means are provided for controlling the level in said reservoir, said means comprising fluid level sensing means 60 and valve means 62 responsive thereto. This fluid level control means enables the fluid flow into said reservoir 58 from a filter 38 and a pump 40 to be regulated, and causes the fluid level in reservoir 58 to remain at a constant level.

Figure 3:
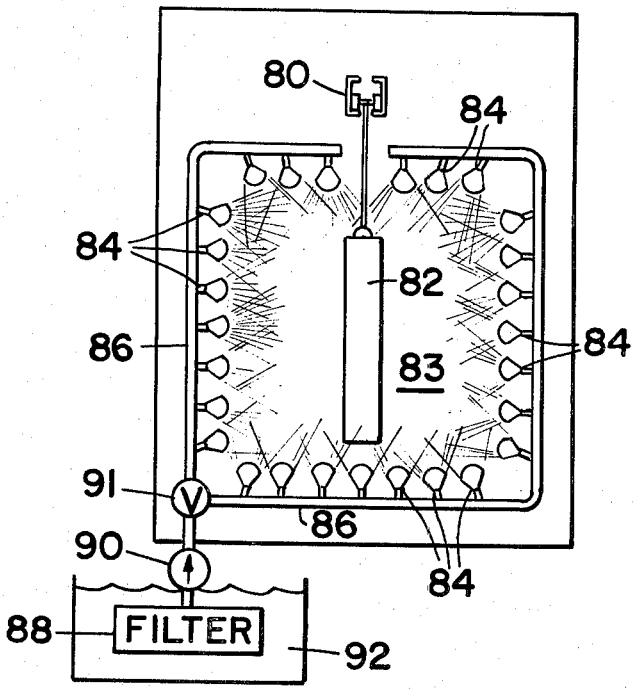
FIG. 3 is an end view of an alternate embodiment of the fluid curtain of the present invention.

An alternate embodiment of the present invention is shown in end view in FIG. 3. In this embodiment, the conveyor means comprises an overhead conveyor 80 for conveying a part 82 through said parts washer apparatus. The fluid curtain 83 in this embodiment is generated by a plurality of nozzles 84, wherein each said nozzle 84 is positioned about the passage across which the fluid barrier 83 is desired. Each nozzle 84 generates a laminar flow, preferably planar, across the opening. The fluid output opening of each nozzle 84 may be defined in a fan shape, or the ends of the nozzle may be simply pinched close together, such that a laminar fluid flow is emitted therefrom when fluid is communicated thereto. A pipe 86 is used to both couple fluid to said nozzles 84 and to support them about said opening. A conventional filter 88, pump 90, and flow control valve 91 supplies the fluid necessary from a fluid source 92 for the operation of said nozzles 84.

It is to be understood that the foregoing description is merely illustrative of a preferred embodiment of the invention and that the scope of the invention is not to be limited thereto but is to be determined by the scope of the appended claims.

What is claimed is:

1. In a parts washer (10) having a wash zone (12) and passage means (19) defining an opening of said wash zone (12), the improvement comprising:

means for passing a generally continuous liquid curtain (30) across the opening defined by said passage means (19), said means including reservoir means (34) for storing liquid, said reservoir means positioned at the top of said wash zone (12), and said reservoir means (34) having at least one edge of a construction sufficient for distributing liquid flowing from the reservoir means (34) over said edge at a predetermined and uniform rate and in a uniform laminar manner, and means (42,44) for controlling the rate of liquid flow from said reservoir means (34).

2. The parts washer (10) as set forth in claim 1 including:

a second zone (14) adjacent said wash zone (12);

second passage means (21) defining an opening between said wash zone (12) and said adjacent zone (14); and means (34 or 58) for passing a generally continuous liquid curtain (32 or 50) across the opening defined by said second passage means (21).

3. A method of isolating a wash zone (12) in a parts washer (10) having openings defining entrance and exit passages (19, 21) of said wash zone (12), comprising:

passing a generally continuous laminar liquid curtain (30 or 32) across at least one of said openings, including supplying a source of liquid to a reservoir (34) positioned at the top of said wash zone (12) and maintaining a level of liquid in said reservoir (34) sufficient to provide a continuous flow of the liquid over at least one edge (36 or 46) of said reservoir (34).

* * * * *